United States Patent [19]

Viner

[11] Patent Number: 4,715,914

[45] Date of Patent: Dec. 29, 1987

[54] FABRIC REPAIR IMPLEMENT AND METHOD OF MENDING HOLES IN FABRICS

[76] Inventor: Loraine Viner, 1066 S. Ogden Dr., Los Angeles, Calif. 90019

[21] Appl. No.: 28,725

[22] Filed: Mar. 23, 1987

[51] Int. Cl.[4] ..... B32B 35/00

[52] U.S. Cl. ..... 156/94; 38/141; 81/487; 156/579; 223/120; 223/DIG. 2; 269/3; 428/63

[58] Field of Search ..... 38/141; 81/487, 489; 156/94, 579; 223/66, 120, DIG. 2; 269/3; 428/63

[56] References Cited

U.S. PATENT DOCUMENTS

| | | | |
|---|---|---|---|
| 2,101,607 | 12/1937 | Block | 428/63 X |
| 3,513,048 | 5/1970 | Snyder | 428/63 X |
| 4,358,335 | 11/1982 | Reinert | 156/514 |
| 4,406,723 | 9/1983 | Marra et al. | 156/98 |

*Primary Examiner*—Robert A. Dawson
*Attorney, Agent, or Firm*—Philip D. Junkins

[57] ABSTRACT

A hand-held implement for use in the repair of wear holes and tears in fabric apparel items, particularly socks, T-shirts and sweat suits, in cooperation with fabric hole patch pre-forms bearing a heat activated adhesive coating. The implement is an egg-shaped form having a handgrip handle extending downwardly from the smaller end of the form and having a flattened anvil surface area at its larger head end. A fabric heat-resistant cover, having a Teflon coating, encompasses the egg-shaped form for interface with the fabric of an apparel item in the area requiring hole repair, a pre-form patch material bearing a heat activated adhesive coating, and a hand-held heated ironing device for the application of heat and pressure to the apparel item and patch material in opposition to the egg-shaped form and its flattened anvil surface area.

13 Claims, 4 Drawing Figures

FABRIC REPAIR IMPLEMENT AND METHOD OF MENDING HOLES IN FABRICS

BACKGROUND OF THE INVENTION

This invention relates to a fabric repair implement and method of repairing or mending holes in socks, T-shirts and other clothing items. More particularly the invention relates to the repair of such holes through the use of a unique implement and associated patch forms which may be readily utilized without laborious hand stitching.

In the past, the appearance or discovery of wear holes or tear holes in clothing items, particularly socks, sweat suits and shirts worn by children in running and hard play activities, has usually resulted in one of two alternative actions, i.e., discarding of the item of clothing or the time consuming and often difficult process of darning or mending the item in the hole or tear area. Until recently, the darning of sock holes and the stitch mending of holes in other items of clothing was a regular part of a woman's household activities. With the advent of the so called "working woman" or "working wife," darning and hole mending have (for the most part) become an art or task of the past and socks and T-shirts with holes are regularly discarded.

It is an object of the present invention to provide a unique repair implement with associated patch forms which may be readily utilized to repair holes in socks and other clothing items without darning or stitch mending.

It is another object of the invention to provide a simple but unique method for repairing holes in clothing items without laborious hand stitching, thread weaving or darning.

These and other objects and advantages of the invention will become apparent from the following summary and detailed descriptions thereof taken in conjunction with the accompanying drawing figures.

SUMMARY OF THE INVENTION

The present invention relates to a fabric hole repair implement with associated patch pre-forms and asimple but unique method for repairing holes in socks and other clothing items without hand stitching, thread weaving or darning. The invention is particularly directed to the rapid repair of wear holes and tear holes in socks, T-shirts and sweat suits worn by children in running and hard play activities and by adults in a wide variety of athletic and hard wear activities. It is not intended to replace tedious darning or invisible weaving techniques for repairing holes in expensive woven fabrics where weaving or repair time is of no consequence.

The fabric hole repair implement comprises an egg-shaped form having a supporting handle extending downwardly from the smaller end of the form and a flattened anvil surface area at the larger head end of the form. The egg-shaped form has a diameter ranging from about 1½ to about 2½ inches with the handle formed for easy hand gripping by the user. Surrounding the egg-shaped form is a tight-woven or spun-bonded fabric cover including an inner layer of foam plastic padding material. The fabric cover also includes a Teflon outer coating and is provided with drawstring means for maintaining the cover (and padding layer) on the form and in relatively smooth interface with the flattened anvil area of the form.

To repair a wear or tear hole in a clothing item, the item is turned inside out and drawn over the egg-shaped form and its fabric cover with the hole area of the clothing item positioned central of the flattened area of the head end of the form and with such item maintained over the form by hand grasping of the item and supporting handle of the form. A circular, ovate, square or rectangular patch form of fabric (of color substantially matching the color of the clothing item under repair), bearing a thermoplastic adhesive coating on one side thereof, is interfaced on its adhesive side with the hole and surrounding area of the clothing item. A heated flatiron or other hot object is pressed to the patch form in opposition to the egg-shaped form and its anvil surface area with the resin coating thereof softened to form an adhesive interface between the inside of the clothing material and the fabric of the patch form. The resin coating of the patch form is precluded from adhering to the egg-shaped form and its fabric cover because of the Teflon coating on the cover material. Upon removal of the heat and pressure source from the patch form the resin adhesive sets forming a permanent bond between the patch material and the clothing material completing the hole repair procedure.

BRIEF DESCRIPTION OF THE DRAWING FIGURES

The invention is illustrated in the accompanying drawing figures in which.

DETAILED DESCRIPTION OF THE INVENTION

Figure 1:
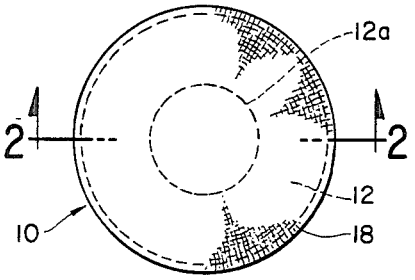
FIG. 1 is a top view of a preferred form of the fabric hole repair implement of the present invention.
Figure 2:
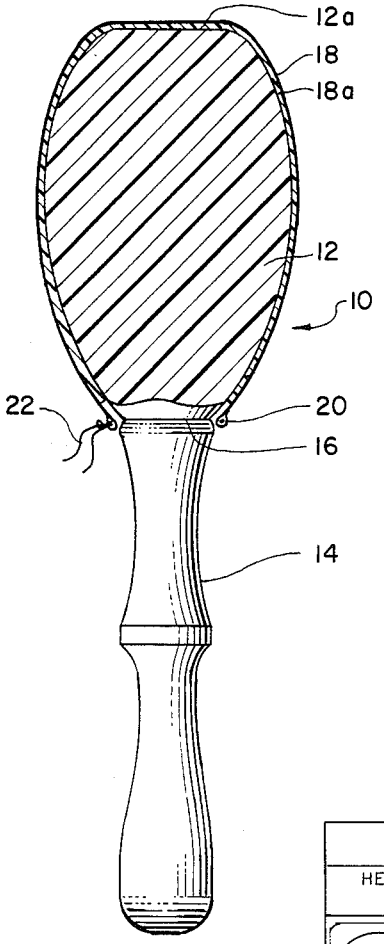
FIG. 2 is a side section view of the fabric hole repair implement of FIG. 1 taken along line 2—2 of such figures.
Figure 3:
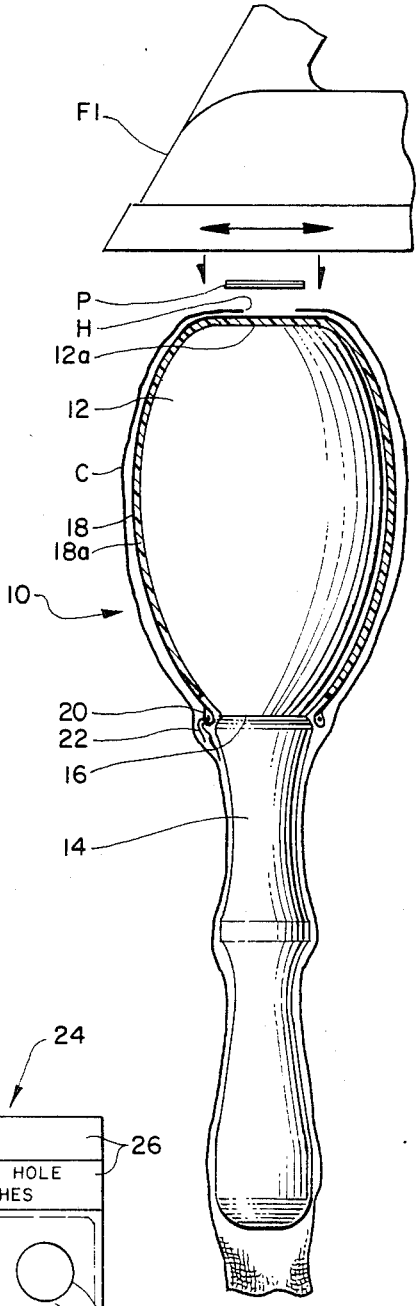
FIG. 3 is a side view of the fabric hole repair implement of the invention with the clothing item in place on the implement and positioned to receive a patch form.

A preferred embodiment of the fabric hole repair implement of the invention is shown in FIGS. 1-3 on the drawing sheet. The repair implement, designated generally by the numeral 10, is comprised of an egg-shaped form 12 having a supporting handgrip handle portion 14 extending downwardly from the smaller end of the form. The form 12 has a flattened anvil surface area **12*a* at its larger head end and an annular channel 16 at the juncture of the form and its handle. Surrounding the egg-shaped form 12 is a fabric cover 18 including an inner layer of foam plastic padding material 18*a*. The cover 18 may take the form of a small bag or be of circular shape and preferably is provided with a drawstring channel 20 and drawstring 22 for constriction of the edge of the cover 18 in the channel 16 of the form 12 to maintain the cover on the form and in relatively smooth interface with the flattened anvil surface area 12*a*** of the form. The fabric cover includes an outer Teflon coating.

In FIG. 3 the repair form 12 (with handle 14 and fabric cover 18) is shown in hole repair position with a clothing item C (in inside-out orientation) enclosing the form and cover and with the fabric hole H of the clothing item positioned in proximity with the flattened anvil surface area 12*a* of the form. A color-matched patch pre-form P is positioned over hole H and the surrounding material of the clothing item with the adhesive side of the pre-form interfaced with such material. A heated flatiron FI (only partially shown in FIG. 3) is pressed to the patch pre-form P, clothing material C and cover 18 in opposition to the flattened anvil surface area of the hand held and supported hole repair form 12. The heat of the flatiron (or other heated object) softens the adhesive of patch pre-form P and under opposing hand pressure impregnates both the patch fabric and clothing material. With the removal of the flatiron, the adhesive cools and sets thereby bonding the patch pre-form to the clothing material and repairing the hole in simple and rapid fashion. The repaired clothing item is thereafter removed from the repair form 12 and turned repair-side-in for continued use. The material of the clothing item and patch fabric do not adhere to the repair form 12 or form cover 18 because the high temperature outer Teflon coating on the cover material displays no affinity to the adhesive of the patch pre-form P.

The adhesive coating on the patch pre-form P may be of any of the well-known thermoplastic types which are capable of softening when heated and hardening again when cooled. Thus, the patch pre-form material (preferably a stretchable knitted fabric) may be coated in known manner with a suitable synthetic hot melt, solvent based or aqueous based adhesive material which has a softening point temperature in excess of high fabric washing temperatures and which is not subject to degradation with repeated laundering. Further, the softening point temperature of the patch adhesive must be below the softening point temperature of the Teflon coating on cover 18 surrounding the repair form 12.

Figure 4:
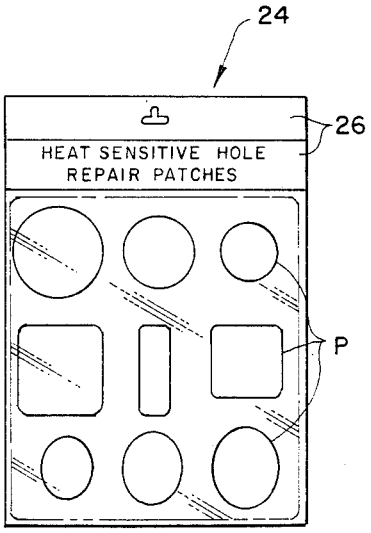
FIG. 4 is a front view of a clear plastic package containing an assortment of patch forms for use in the practice of the methodology of the invention.

The fabric material forming the patch pre-form P may be of any durable ironable woven material or synthetic fabric mayerial reasonably comparable in weave or texture with the majority of sock, T-shirt and sweat suit clothing materials. Stretchable, double-knit cotton fabrics are of particular interest as patch form materials. The pre-form patch material P is supplied in a standard selection of basic colors (white, brown, blue, red, black, gray, etc.) and may be pre-cut into small circular, ovate, square or rectangular shapes P and packaged in a transparent package 24 (with top header portion 26) as shown in FIG. 4. Alternatively, the patch material may be supplied as a group of variously colored small sheets (with appropriate adhesive coating) from which patches may be cut to desired shape for fabric hole repair.

As previously mentioned, the present invention is particularly directed to the repair of holes in a group of apparel items, including socks, T-shirts and sweat suits. The fabric materials from which these apparel items are made are usually of knit structure and in many instances are stretchable and such materials must be capable of withstanding the temperatures normally associated with a heated flatiron. Thus, knitted cotton and cotton blend apparel items (requiring wear hole and tear repair) are particularly suited to application of the repair implement and associated patch pre-forms and apparel repair methodology of the invention.

The repair implement or mandrel 10 comprised of egg-shaped form 12 and supporting handgrip handle portion 14 may be made of wood as a unitary turned piece or may be molded of appropriate plastic material. When formed as a plastic molding the the plastic material should be of a type capable of withstanding (without softening or degrading) temperatures as may be applied by a flatiron or other heated object used to apply heat and pressure to the flattened anvil surface area of form 12 to fuse the patch pre-form P to an item of clothing C during the hole repair procedure as specified within the methodology of the invention.

In the specification and drawing figures there has been set forth a preferred embodiment of the invention and although specific terms have been employed in describing the invention, they are used in a generic and descriptive sense only and not for purposes of limitation, the scope of the invention being defined in the following claims.

What is claimed is:

1. A hand-held implement for use in the repair of wear holes and tears in fabric apparel items in cooperation with fabric hole patch pre-forms bearing a heat activated adhesive coating comprising: an egg-shaped form having a handgrip handle extending downwardly from the smaller end thereof and having a flattened anvil surface area at its larger head end; and a fabric heat-resistant cover encompassing said egg-shaped form and maintained in relatively close smooth interface with said flattened surface area, said fabric bearing on its outer surface a Teflon coating for interface with the fabric of an apparel item in the area thereof requiring repair, a pre-form patch material bearing a heat activated adhesive coating and a heated ironing device.

2. A hand-held implement for use in the repair of wear holes and tears in fabric apparel items in cooperation with fabric hole patch pre-forms bearing a heat activated adhesive coating as claimed in claim 1 wherein the fabric heat-resistant cover encompassing the egg-shaped form is circular in configuration with a drawstring channel at its periphery and has a drawstring in said channel for constriction of said cover over said egg-shaped form to maintain the close smooth interface between said cover and the flattened anvil surface area of said form.

3. A hand-held implement for use in the repair of wear holes and tears in fabric apparel items in cooperation with fabric hole patch pre-forms bearing a heat activated adhesive coating as claimed in claim 1 wherein a cushioning layer of padding material is interposed between the fabric heat-resistant cover and the egg-shaped form.

4. A hand-held implement for use in the repair of wear holes and tears in fabric apparel items in cooperation with fabric hole patch pre-forms bearing a heat activated adhesive coating as claimed in claim 3 wherein the interposed padding material is affixed to the underside of the fabric heat-resistant cover.

5. A hand-held implement for use in the repair of wear holes and tears in fabric apparel items in cooperation with fabric hole patch pre-forms bearing a heat activated adhesive coating as claimed in claim 3 wherein the interposed padding material is a foam plastic material.

6. A hand-held implement for use in the repair of wear holes and tears in fabric apparel items in cooperation with fabric hole patch pre-forms bearing a heat activated adhesive coating comprising: a fabric hole repair mandrel for receiving fabric apparel items in the area of wear holes and tears, said mandrel consisting of an egg-shaped portion having a flattened anvil surface area at its upper and larger head end and a handgrip portion extending downwardly from the lower and smaller end of said egg-shaped portion; and a fabric heat-resistant cover encompassing the egg-shaped portion of said mandrel and maintained in relatively close smooth interface with the flattened anvil surface area of the egg-shaped portion of said mandrel, said fabric cover bearing on its outer surface a Teflon coating for interface with the fabric material of apparel items in the area of wear holes and tears therein, pre-form patch materials bearing a heat activated adhesive coating interfacing with the fabric material of said apparel items and a heated pressing device for application of heat and pressure to said apparel items and said patch materials in opposition to said mandrel and the flattened anvil surface area of the egg-shaped portion thereof.

7. A hand-held implement for use in the repair of wear holes and tears in fabric apparel items in cooperation with fabric hole patch pre-forms bearing a heat activated adhesive coating as claimed in claim 6 wherein the fabric heat-resistant cover encompassing the egg-shaped portion of said mandrel is circular in configuration with a drawstring channel at its periphery and has a drawstring in said channel for constriction of said cover over said egg-shaped portion to maintain the relatively close smooth interface between said cover and the flattened anvil surface area of the egg-shaped portion of said mandrel.

8. A hand-held implement for use in the repair of wear holes and tears in fabric apparel items in cooperation with fabric hole patch pre-forms bearing a heat activated adhesive coating as claimed in claim 6 wherein a cushioning layer of padding material is interposed between the fabric heat-resistant cover and the egg-shaped portion of said mandrel.

9. A hand-held implement for use in the repair of wear holes and tears in fabric apparel items in cooperatron with fabric hole patch pre-forms bearing a heat activated adhesive coating as claimed in claim 8 wherein the interposed padding material is affixed to the underside of the fabric heat-resistant cover.

10. A hand-held implement for use in the repair of wear holes and tears in fabric apparel items in cooperation with fabric hole patch pre-forms bearing a heat activated adhesive coating as claimed in claim 8 wherein the interposed padding material is a foam plastic material.

11. A hand-held implement for use in the repair of wear holes and tears in fabric apparel items in cooperation with fabric hole patch pre-forms bearing a heat activated adhesive coating as claimed in claim 6 wherein said fabric apparel items are made of ironable materials and are selected from the group consisting of socks, T-shirts and sweat suits.

12. A hand-held implement for use in the repair of wear holes and tears in fabric apparel items in cooperation with fabric hole patch pre-forms bearing a heat activated adhesive coating as claimed in claim 11 wherein the ironable material of said fabric apparel items are selected from the group consisting of knitted cotton and cotton blend materials.

13. A method for the repair of wear holes and tears in fabric apparel items comprising:

(a) turning the fabric apparel item requiring hole repair inside-out to expose the inner side of said apparel item;

(b) positioning the fabric apparel item in the area of the hole requiring repair over a hand-held mandrel having a flattened anvil surface area at its upper head end, said mandrel having a fabric heat-resistant cover bearing on its outer surface a Teflon coating for interface with said apparel item;

(c) positioning a hole patch pre-form of fabric material bearing a heat activated adhesive coating on one side thereof over the apparel item in the area of the hole requiring repair, the adhesive coating of said patch pre-form interfacing with said apparel item and exposed portions of the fabric heat-resistant cover of said mandrel;

(d) heating the hole patch pre-form of fabric material and interfacing apparel item with a hand-held, heated ironing device applying pressure to said patch pre-form and apparel item in opposition to the hand-held mandrel and the upper flattened anvil surface area thereof to join said patch pre-form to said apparel item in the area thereof requiring hole repair; and (e) removing said hand-held, heated ironing device and allowing the fabric material of said patch pre-form and said apparel item to cool to set said heat activated adhesive and thereby repair said apparel item.

* * * * *